US006270155B1

(12) United States Patent
Rashid

(10) Patent No.: US 6,270,155 B1
(45) Date of Patent: Aug. 7, 2001

(54) FOLDABLE UPHOLSTERED CHAIR

(75) Inventor: Karim Rashid, New York, NY (US)

(73) Assignee: Umbra, Inc., Buffalo, NY (US)

( * ) Notice: Subject to any disclaimer, the term of this patent is extended or adjusted under 35 U.S.C. 154(b) by 0 days.

(21) Appl. No.: 09/482,710

(22) Filed: Jan. 13, 2000

(51) Int. Cl.[7] ..... A47C 13/00

(52) U.S. Cl. ..... 297/1; 297/118; 5/655.9; 5/657

(58) Field of Search ..... 297/1, 3, 118, 297/119, 129, 423.3, 45.164, 440.1, 440.14; 5/630, 632, 652, 655.9, 657, 722

(56) References Cited

U.S. PATENT DOCUMENTS

| | | | | |
|---|---|---|---|---|
| D. 167,514 | | 8/1952 | Hicks . | |
| 2,108,241 | * | 2/1938 | Wallace | 297/1 |
| 2,593,319 | * | 4/1952 | Levitin et al. | 297/119 |
| 2,672,921 | * | 3/1954 | Herrick | 297/118 |
| 2,693,846 | | 11/1954 | Luttio . | |
| 2,896,695 | | 7/1959 | Ashworth . | |
| 2,966,205 | * | 12/1960 | Blaschko | 5/657 X |
| 3,469,882 | | 9/1969 | Larsen . | |
| 3,672,720 | | 6/1972 | Wilson . | |
| 3,736,023 | | 5/1973 | Lyons . | |
| 3,829,913 | | 8/1974 | Bernard . | |
| 3,902,759 | | 9/1975 | Monteforte et al. . | |
| 4,518,203 | | 5/1985 | White . | |
| 4,635,306 | * | 1/1987 | Willey | 5/657 X |
| 5,299,337 | | 4/1994 | Venza . | |
| 5,597,199 | * | 1/1997 | Hoffman et al. | 297/119 X |

* cited by examiner

*Primary Examiner*—Peter M. Cuomo
*Assistant Examiner*—Stephen Vu
(74) *Attorney, Agent, or Firm*—Saidman DesignLaw Group

(57) ABSTRACT

A folding chaise lounge is made from three foam cushions individually covered in fabric and shaped to form a seat, a leg rest, and an ottoman. The leg rest is attached to the front edge of the seat by an elongated fabric hinge. The leg rest has a gently contoured, convex side which complements a concave contour of the seat, which when opened combine to form a chaise lounge having a gentle, lazy, S-shaped body supporting surface. The opposite side of the leg rest is concavely contoured to complement the upper contour of the ottoman. The ottoman is a separate piece, unconnected to either the seat or leg rest. When folded in repose, the leg rest nests within the concave seat, and when the ottoman is placed within the concave contour of the leg rest, the assemblage forms a cube for easy storage, shipping and handling.

16 Claims, 1 Drawing Sheet

FOLDABLE UPHOLSTERED CHAIR

BACKGROUND OF THE INVENTION

1. Field of the Invention

This invention relates to a folding chair with ottoman, and more particularly relates to a chair and ottoman capable of folding into a compact cube for storing and transport.

2. Description of Related Art

The broad concept of a chair which can be folded into a compact shape for storage and transport is known, being disclosed by Luttio, U.S. Pat. No. 2,693,846, Ashworth, U.S. Pat. No. 2,896,695, Larsen, U.S. Pat. No. 3,469,882, Wilson, U.S. Pat. No. 3,672,720, Lyons, U.S. Pat. No. 3,736,023, and Monteforte et al., U.S. Pat. No. 3,902,759. Luttio and Ashworth show a chair folding into a cube, and while Wilson does not mention a cube shape, his chair could be so designed. Larsen, Lyons, and Monteforte et al. teach the use of fabric hinges.

Luttio and Ashworth, supra, disclose chairs having wooden frames with sharp edges and corners and exposed metal hinges, all of which are dangerous to the safety of children and other people for whom their chairs are designed. Luttio's chair folds into an ottoman for use with another chair, but it lacks an ottoman for supporting the feet of the user of the disclosed chair. Also, the contours of Luttio's chair are defined by wooden slats, are lumpy, particularly in the seating area, which renders the chair somewhat uncomfortable. Ashworth's chair, when unfolded, has a low flat seat and an inclined flat back rest meeting at a sharp, concave corner, providing for uncomfortable seating.

The many embodiments of chairs disclosed by Wilson share the common attribute of a deep trough in the upper surface of a large, resiliently deformable, foamed cushion. A bolster, unconnected to the cushion, is shaped complementary to the trough to fit therein to complete the rectangular shape of the cushion when both are assembled for storage. A chair with a limited, unconnected back is disclosed, but there is no leg or footrest provided.

The chairs of Larsen, Lyons, and Monteforte et al., supra, are complex structures composed of many parts, e.g., 9 for Lyons, which are relatively expensive to manufacture and complicated to fold and store. Although they are suitable for their intended purposes, namely, to provide low lying supports primarily for lounging on floors to watch television, they are too low for normal seating comfort.

OBJECTS AND SUMMARY OF THE INVENTION

The present invention overcomes the difficulties described above by providing a chair having a minimal number of parts which fold and stack together to form a compact cube which is easy to store and transport.

The present invention accomplishes the above by providing a chair having a back and a gently contoured, concave seat. Attached to the front edge of the seat by an elongated fabric hinge is a leg rest. The leg rest has a gently contoured, convex side which complements the concave contour of the seat. The opposite side of the leg rest is concavely contoured to complement the upper contour of an ottoman. The ottoman is a separate piece. When folded, the leg rest nests within the concave seat, and when the ottoman is placed within the concave contour of the leg rest, the assemblage forms a cube. When opened, the seat and leg rest combine to form a chaise lounge having a gentle, lazy, S-shaped body supporting surface which provides a comfortable, ergonomic support for the user's body and legs. The ottoman is movable relative to the seat and leg rest and can be placed at the foot of the leg rest to support the user's feet or can be stored beneath the leg rest.

It is an object of the invention to provide a lightweight, durable, attractive, comfortable chair and ottoman that can be easily shipped, stored and moved about.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
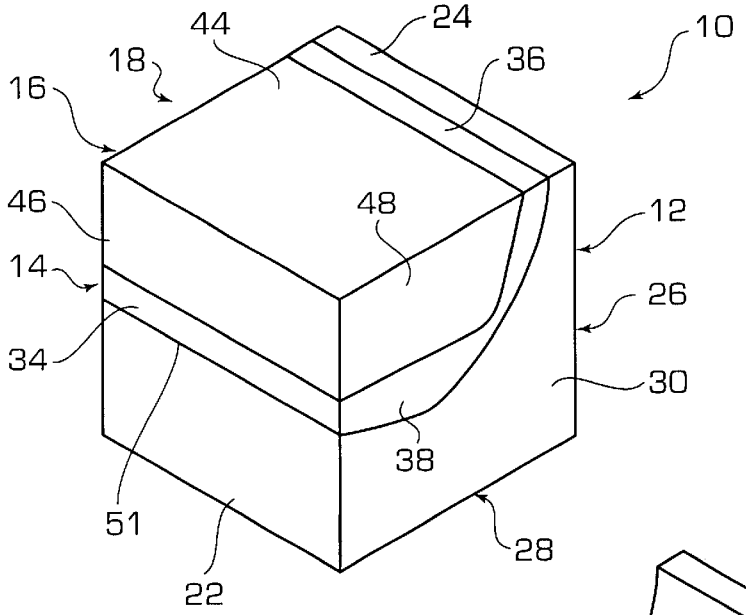
FIG. 1 is a perspective view which illustrates a preferred embodiment of the present invention when folded and stacked to form a cube.
Figure 2:
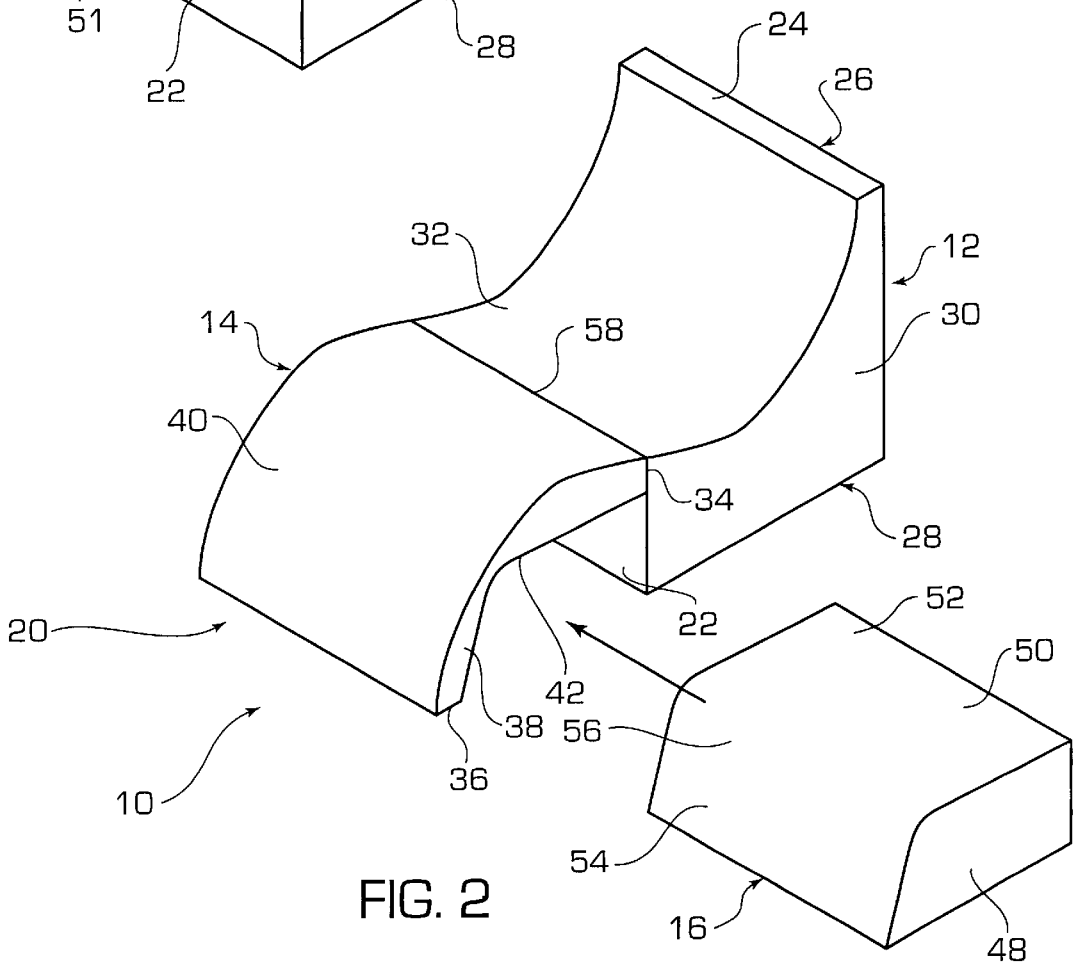
FIG. 2 is an exploded perspective view of the invention of FIG. 1 when unfolded and separated to form a lounge chair and ottoman.

Referring to FIGS. 1 and 2, wherein like reference numerals represent identical or corresponding parts throughout the several views, a preferred embodiment of the chair of the present invention is indicated generally by reference numeral 10.

Chair 10 is comprised of a seat 12, a leg rest 14, and an ottoman 16. It is shown in its assembled state in FIG. 1, where it can be seen to form a cube 18, and in its opened state in FIG. 2, where it forms a lazy, S-shaped chaise lounge 20. Each of seat 12, leg rest 14, and ottoman 16 preferably comprises a block of material, such as a foamed cushion, which imbues it with the attributes of ease of construction and economy of manufacturing, packaging, and shipping. Equally important, chair 10 is of reduced weight, compared to other chairs of similar size, so that the owner thereof can easily use, move, and store it.

A removable cover of fabric surrounds each block of material to protect and adorn it. The fabric and its pattern are chosen from aesthetic considerations to fit the environment of its intended use. It can be changed easily to allow chair 10 to be given a new look for each new use. For example, the fabric covers may be secured in place about each block of material by zippers, which are preferably hidden from view by small fabric flaps.

Seat 12 has a rectangular front 22 and a rectangular top 24. For ease in explanation, the designations of direction—front, top, back, etc., refer to chair 10 as shown in its assembled state of FIG. 1, a state also referred to herein as "in repose". The long dimension of both rectangles extends transversely of chair 10. Seat 12 further includes a square back 26 and an orthogonally related bottom 28, both of which are not visible in the drawings. A pair of sides 30 (only one of which is visible in the drawings) are orthogonal to said front 22, top 24, back 26, and bottom 28.

Seat 12 further includes a smoothly contoured, concave upper seating surface 32 (FIG. 2) that is bordered front and back by front 22 and top 24, respectively, and transversely of chair 10 by sides 30. Seating surface 32 is preferably contoured substantially as shown, but other configurations are within the purview of the present invention.

Leg rest 14 has an overall arcuate shape defined by a rectangular forwardly facing surface 34, a rectangular upwardly facing surface 36, and a pair of curved outwardly facing side surfaces 38 (only one of which is visible in the drawings). A convex leg-supporting surface 40 (FIG. 2) is bordered front and back by surfaces 34 and 36 and transversely of chair 10 by outwardly facing side surfaces 38.

Convex leg supporting surface 40 is complementary in contour to concave seating surface 32 and nests snuggly therein when chair 10 is assembled as cube 18. Leg rest 14 is completed by a concave surface 42 which is on the other side of convex surface 40 and is likewise bordered front and back by surfaces 34 and 36 and bordered transversely of chair 10 by outwardly facing side surfaces 38. As can be clearly seen, the contour of concave surface 42 may be different than the contour of convex leg supporting surface 40. The foamed material of leg rest 14 has sufficient rigidity to support a pair of legs of a human being without unduly collapsing.

The shape (FIG. 1) of ottoman 16 is defined by a rectangular top 44, a rectangular front 46 orthogonally related to top 44, a pair of sides 48 orthogonally related to both top 44 and front 46, and a smoothly contoured, convex surface 50 (FIG. 2) transversely spanning sides 48 and bordered front and back by front 46 and top 44, respectively. When in the orientation of FIG. 2, convex surface 50 can be seen to have a relatively flat, foot supporting portion 52 and an inclined portion 54 connected by a smooth, rounded corner 56. Concave surface 42 of leg rest 14 is complementary in contour to convex surface 50 of ottoman 16. When chair 10 is assembled as cube 18, ottoman 16 nests snuggly within the confines of concave surface 42.

Ottoman 16 is an independent structure, separate from and unconnected to either seat 12 or leg rest 14, allowing it considerable utility. When chair 10 is unfolded as chaise lounge 20, ottoman 16 can be placed in any desired orientation at the foot of leg rest 14 as a footrest. Alternatively, ottoman 16 can be slid underneath leg rest 14, as indicated by the arrow (FIG. 2), within the confines of concave surface 42, where ottoman 16 is out of the way, inconspicuous, and aids in supporting the legs on leg rest 14. Seat 12 and leg rest 14 are preferably joined together, however.

Seat 12 and leg rest 14 are pivotally connected by a fabric hinge 58 at the juncture of concave upper seating surface 32 of seat 12 and convex leg supporting surface 40 of leg rest 14 (FIG. 2). When opened to form chaise lounge 20, flat, forwardly facing surface 34 of leg rest 14 abuts front 22 of seat 12, where hinge 58 holds it securely in place. Downward pressure on leg rest 14 due to a pair of legs resting thereon further compresses surface 34 and front 22 together. Being held in intimate, unshifting contact by hinge 58, concave upper seating surface 32 of seat 12 and convex leg supporting surface 40 of leg rest 14 combine to form the lazy S-shaped, body-supporting surface mentioned above.

It is a feature of the invention that all transverse dimensions of the surfaces and transverse edges of all the pieces are preferably of the same, preselected length. This facilitates the desideratum that when folded, the assemblage will form cube 18. Since the transverse dimensions of the back and bottom of seat 12 are the same as the transverse dimensions of leg rest 14 and ottoman 16, it follows that the opposing dimensions are the same also, since the back and bottom are square. To complete the cube, the dimensions of the narrow widths of front 22, forwardly facing surface 34, and front 46 add up to the same preselected length, while the dimensions of the narrow widths of top 44, upwardly facing surface 36, and top 24 also add up to the same preselected length (see FIG. 1). Thus, when leg rest 14 is folded back to nest on concave seating surface 32 of seat 12 and ottoman 16 is placed within concave surface 42 of leg rest 14, seat 12, leg rest 14, and ottoman 16 will form cube 18.

It is clear from the above that the objects of the invention have been fulfilled.

The purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims:

I claim as my invention:

1. A chair comprising:

a seat, a leg rest, and an ottoman;

said seat comprising an integral block of material having a seating surface;

said leg rest comprising an integral block of material having a leg supporting surface shaped complementary to said seating surface, said leg rest further comprising a curved leg rest surface located opposite to said leg supporting surface; and a hinge connecting said seat to said leg rest;

said ottoman comprising a curved foot rest surface shaped complementary to said leg rest surface;

the assemblage of said seat, said leg rest, and said ottoman forming a cube in repose.

2. The chair of claim 1, wherein each of said seat, said leg rest, and said ottoman is covered with a fabric covering.

3. The chair of claim 2, wherein said hinge comprises a fabric hinge.

4. The chair of claim 1, wherein said seating surface of said seat is smoothly contoured.

5. The chair of claim 1, wherein said leg rest surface is concave.

6. The chair of claim 5, wherein said foot supporting surface is convex.

7. The chair of claim 6, wherein said leg rest surface has a different contour than said leg supporting surface.

8. A chair comprising:

a seat, a leg rest, and an ottoman;

said seat comprising an integral block of material having a concave seating surface;

said leg rest comprising an integral block of material having a convex leg supporting surface shaped complementary to said concave seating surface, and a concave leg rest surface located on the opposite side of said convex leg supporting surface; and a hinge connecting said concave seating surface of said seat to said convex leg supporting surface of said leg rest;

said ottoman comprising an integral block of material having a convex foot supporting surface shaped complementary to said concave leg rest surface;

the assemblage of said seat, said leg rest, and said ottoman forming a cube in repose.

9. The chair of claim 8, wherein each of said seat, said leg rest, and said ottoman is covered with a fabric covering.

10. The chair of claim 9, wherein said hinge comprises a fabric hinge.

11. The chair of claim 8, wherein said concave seating surface of said seat is smoothly contoured.

12. The chair of claim 8, wherein said concave leg rest surface has a different contour than said convex leg supporting surface.

13. The chair of claim 8, wherein said ottoman comprises an independent structure, separate from and unconnected to either said seat or said leg rest.

14. A chair comprising:

a seat, a leg rest, and an ottoman;

said seat comprising an integral block of material having in repose a seat front, a seat top, a seat back, a seat bottom, and a pair of seat sides, and a smoothly contoured, concave seating surface extending from said seat front to said seat top and from one of said seat sides to the other of said seat sides;

said leg rest comprising an integral block of material having in repose a forwardly directed surface, an upwardly directed surface, a pair of generally planar side surfaces having arcuate edges, a convex leg supporting surface extending from said forwardly directed surface to said upwardly directed surface, and from one of said planar side surfaces to the other of said planar side surfaces; said convex leg supporting surface being shaped complementary to said concave seating surface; and a concave leg rest surface located opposite to said convex leg supporting surface;

a hinge connecting said convex leg supporting surface to said concave seating surface along adjacent edges thereof; and said ottoman comprising an integral block of material having in repose an ottoman front, an ottoman top, a pair of ottoman sides, and a convex foot supporting surface extending from said ottoman front to said ottoman top and from one of said ottoman sides to the other of said ottoman sides, said convex foot supporting surface being complementary in contour to said concave leg rest surface; and wherein when said leg rest is folded about said hinge such that said leg supporting surface of said leg rest nests in said concave seating surface of said seat and when said convex foot supporting surface of said ottoman is placed in said concave leg rest surface of said leg rest, the assemblage of said seat, leg rest, and ottoman form in repose a cube; and when said leg rest is pivoted about said hinge away from said seat, said concave seating surface and said convex leg supporting surface form a lazy, S-shaped body supporting surface.

15. The chair of claim 14, wherein each of said seat, leg rest and ottoman includes in repose a transverse dimension, a vertical dimension and a depth dimension, said transverse dimensions of said seat, said leg rest, and said ottoman each having a same preselected length; a first sum of said vertical dimensions of said seat front, said forwardly directed surface of said leg rest, and said ottoman front being equal to said preselected length; and a second sum of said depth dimensions of said convex leg supporting surface of said ottoman top, said upwardly directed surface of said leg rest, and said seat top being equal said preselected length, so that said assemblage forms said cube in repose.

16. The chair of claim 14, wherein said ottoman comprises an independent structure, separate from and unconnected to either said seat or said leg rest.

* * * * *